US006560998B2

(12) United States Patent
Wright

(10) Patent No.: US 6,560,998 B2
(45) Date of Patent: May 13, 2003

(54) DOOR BOOT WITH REDUCED OPENING FORCE

(75) Inventor: Michael L. Wright, Newton, IA (US)

(73) Assignee: Maytag Corporation, Newton, IA (US)

( * ) Notice: Subject to any disclaimer, the term of this patent is extended or adjusted under 35 U.S.C. 154(b) by 113 days.

(21) Appl. No.: 09/943,522

(22) Filed: Aug. 30, 2001

(65) Prior Publication Data

US 2003/0041629 A1 Mar. 6, 2003

(51) Int. Cl.[7] ..... D06F 39/14
(52) U.S. Cl. ..... 68/139
(58) Field of Search ..... 68/139, 24, 58; 34/601; 220/849

(56) References Cited

U.S. PATENT DOCUMENTS

| | | | | |
|---|---|---|---|---|
| 2,613,837 A | | 10/1952 | Morton | |
| 2,657,475 A | | 11/1953 | Erickson | |
| 2,722,119 A | * | 11/1955 | Constantine | 68/139 |
| 2,910,854 A | | 11/1959 | Hughes | |
| 2,968,174 A | | 1/1961 | Bell et al. | |
| 3,080,252 A | | 3/1963 | Freier et al. | |
| 3,089,327 A | | 5/1963 | Stilwell, Jr. | |
| 3,276,229 A | | 10/1966 | Deiss | |
| 3,816,942 A | | 6/1974 | Smith | |
| 5,860,300 A | | 1/1999 | Valent | |
| 5,881,579 A | | 3/1999 | Ellingson | |
| 5,970,753 A | | 10/1999 | Johnson et al. | |
| 6,000,248 A | | 12/1999 | Erickson et al. | |
| 6,205,603 B1 | | 3/2001 | Vande Haar | |

* cited by examiner

*Primary Examiner*—Philip R. Coe
(74) *Attorney, Agent, or Firm*—McKee, Voorhees & Sease, P.L.C.

(57) ABSTRACT

A door boot for an appliance is positioned within the access opening of the appliance. A door is movable to a closed position cooperating with the door boot to seal the interior of the appliance cabinet. A relief groove is provided in the door boot which provides flexibility when the door is moved to its open position, and thereby reduces the force necessary to break the seal during opening of the door. The relief groove forms a flexible hinge.

11 Claims, 6 Drawing Sheets

DOOR BOOT WITH REDUCED OPENING FORCE

BACKGROUND OF THE INVENTION

The present invention relates to a door boot with reduced opening force.

U.S. Pat. No. 5,881,579 shows a prior art door boot for use in an appliance such as a washing machines. The door boot forms a seal when the door is closed. The seal extends around the access opening of the appliance.

Industry standards require that the force necessary to open the door must be approximately 15 pounds. The force necessary to open the door includes two components: the strength of the latch holding the door closed, and the resistance force caused by the seal over the access opening. This resistance force is partially due to a vacuum which is created when the door initiates its opening movement, and the seal between the door boot and the door must be overcome before the door can break away and be opened.

It is desirable to be able to reduce the opening force necessary to overcome the resisting force of the seal so that the latching force of the latch can be increased.

Therefore a primary object of the present invention is the provision of an improved door boot with reduced opening force.

A further object of the present invention is the provision of a relief groove in the door boot which permits it to flex and reduces the opening force necessary to overcome the sealing force created by the seal between the door and the door boot.

A further object of the present invention is the provision of an improved door boot having a groove positioned so that the force required to close and seal the door is unaffected, but the force required to open the door is reduced.

A further object of the present invention is the provision of an improved door boot which is economical to manufacture, durable in use, and efficient in operation.

BRIEF SUMMARY OF THE INVENTION

The foregoing objects may be achieved in a sealing system for an appliance comprising a cabinet enclosing an appliance cavity. An access opening is provided in the appliance having an opening perimeter, the access opening providing access from the exterior of the cabinet to the appliance cavity. A door boot extends around the perimeter of the access opening. A door is movably mounted to the cabinet for movement from an open position exposing the access opening for access to the appliance cavity to a closed position in covering relation over the access opening. The door includes a sealing surface and the door boot includes a boot sealing surface. These two surfaces engage one another and provide a seal between the door and the cabinet when the door is in its closed position. This seal causes a resistance force opposing the movement of the door from its closed position to its open position. A relief groove is provided in the door boot permitting the door boot to flex in response to initial movement of the door from its closed position to its open position. The flexing of the door boot reduces the magnitude of the opening force necessary to overcome the resistance force opposing the movement of the door from its closed position to its open position.

A further feature of the present invention is a relief hinge created adjacent the relief groove. The relief hinge flexes during the initial movement of the door from its closed to its open position.

According to another feature of the present invention the entire boot is comprised of a flexible plastic material.

DETAILED DESCRIPTION OF THE PREFERRED EMBODIMENT

Figure 1:
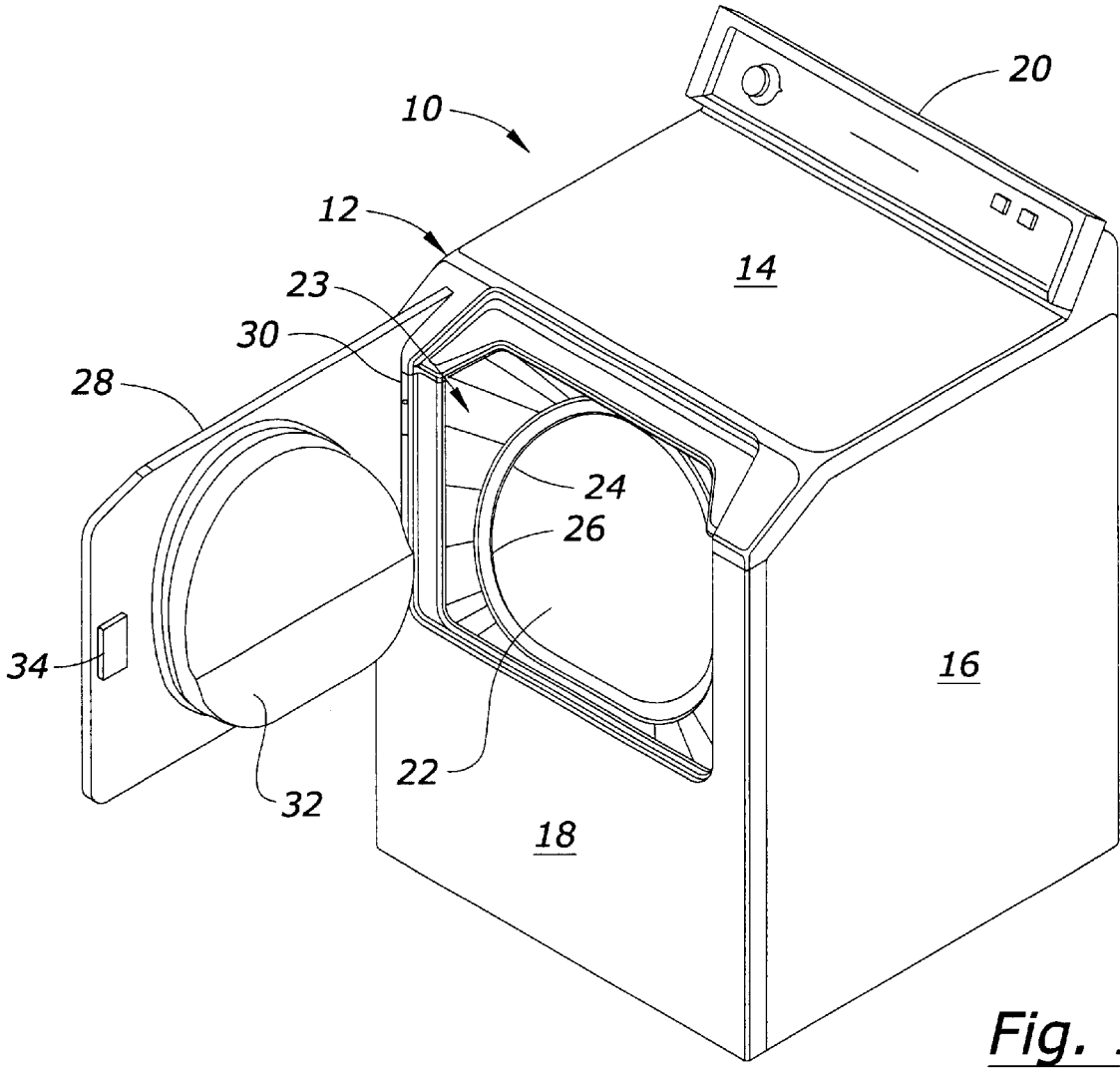
FIG. 1 is a perspective view of an appliance utilizing the door boot of the present invention.

Referring to the drawings the numeral 10 generally designates an appliance. Appliance 10 includes a cabinet 12 having a top wall 14, side wall 16, a front wall 18 and a back panel 20. The cabinet encloses a cabinet cavity in which may be mounted other components of the appliance.

A shroud 23 is provided in the front wall 18, and shroud 23 includes an access opening 24 providing access from the exterior of the cabinet 12 to the interior of the cabinet cavity 22.

Surrounding the access opening 24 is a door boot 26 which comprised of a flexible elastomeric material. Door boot 26 will be described in more detail hereafter.

A door 28 is hinged by door hinges 30 to the cabinet 12 and includes a door plug 32. The door 28 pivots about hinges 30 from a closed position wherein the door plug 32 engages the door boot 26 to an open position such as shown in FIG. 1 exposing the access opening 24. A door latch 34 latches the door in its closed position.

Figure 2:
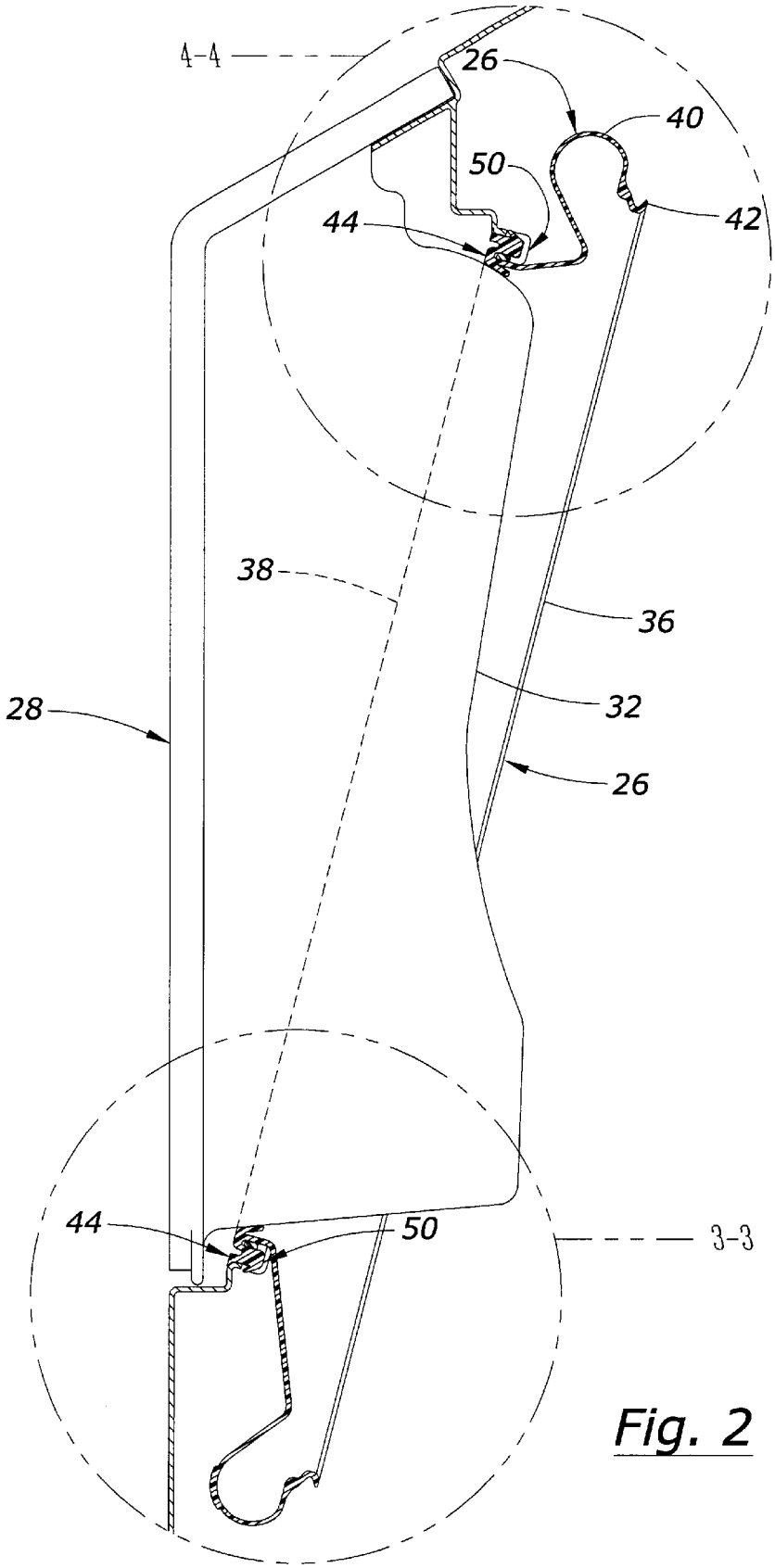
FIG. 2 is a sectional view of the access opening to the appliance, showing the door in its closed position in sealing engagement with the door boot.
Figure 3:
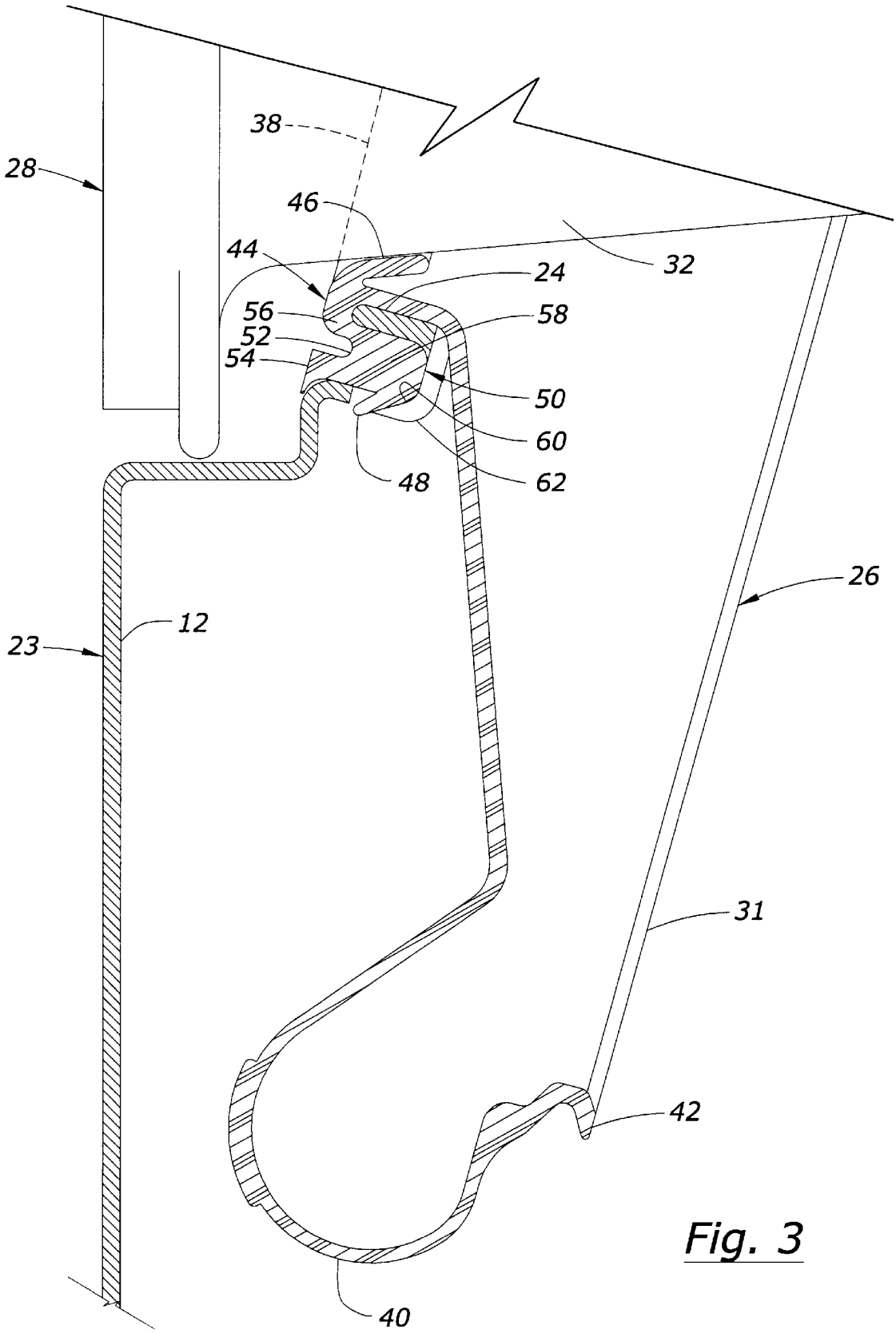
FIG. 3 is an enlarged detailed view taken along line 3—3 of FIG. 2.
Figure 4:
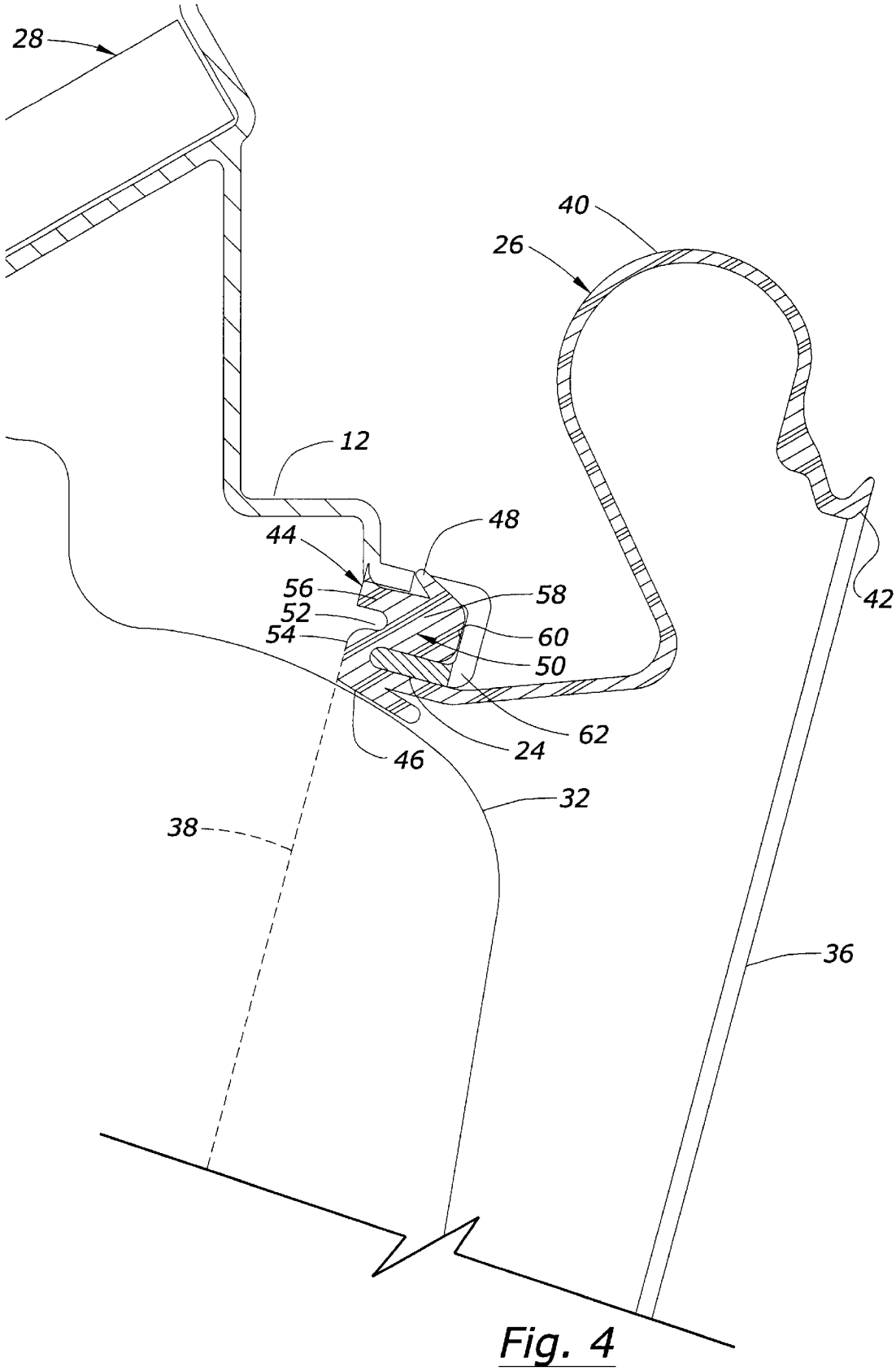
FIG. 4 is an enlarged detailed sectional view taken along line 4—4 of FIG. 2.
Figure 5:
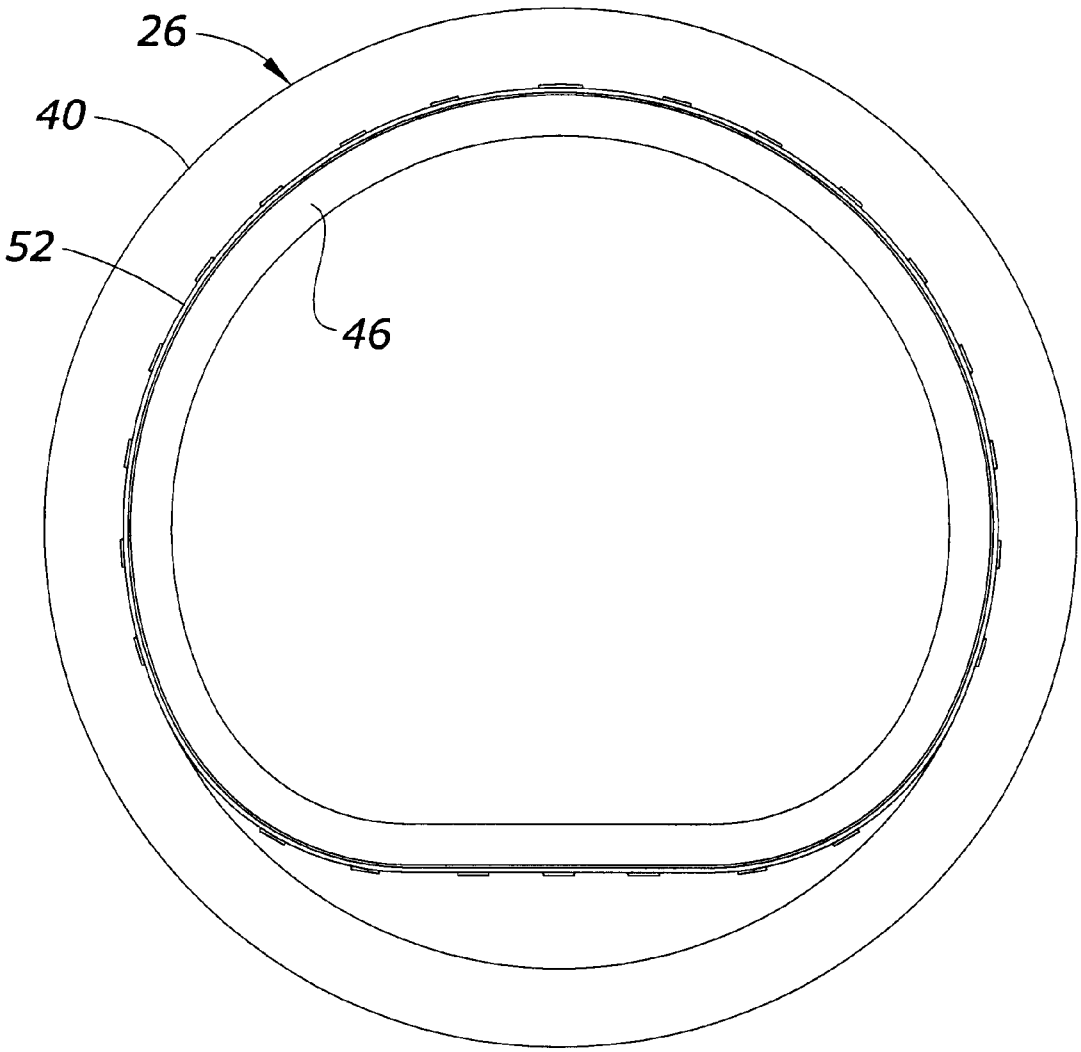
FIG. 5 is a front elevational view of the door boot of the present invention.

Referring to FIG. 2 the door boot 26 includes an interior edge 36 and an exterior edge 38. Between edges 36, 38 is a flexible bulbous portion 40 and an interior rim portion 42. The interior rim portion 42 is adapted to fit within a rotating drum within the appliance so as to prevent fluid from exiting from the rotating drum during rotation. Door boot 26 also includes an exterior rim portion 44. The detail of the exterior rim portion 44 is shown in FIGS. 3 and 4 and includes an annular sealing lip 46 which engages the door plug 32 when the door 28 is closed so as to provide a seal around the door plug 32. Rim portion 44 also includes a locking lip 48 which extends radially inwardly from a relief hinge 50. The relief hinge 50 is comprised of an annular relief groove 52 having a first leg 54 and a second leg 56 on opposite sides thereof. The interior ends of legs 54, 56 are joined by a web 58.

The shroud 23 includes an annular locking slot 60, and relief hinge 50 is frictionally inserted into this U-shaped locking slot 60 as shown in FIGS. 3 and 4. The locking slot 60 includes a locking slot opening 62, and the locking lip 48 of the exterior rim portion 44 protrudes within this locking slot opening and retains the door boot 26 within the access opening 24.

In operation, the door 28 of appliance 10 is moved to its closed position shown in FIG. 2. In this position the door plug 32 protrudes within the access opening 24 and engages the sealing lip 46 of door boot 26. This forms a fluid tight seal between the door 28 and the interior cavity 22 of cabinet 10. The relief hinge 50 and relief groove 52 do not affect the force necessary to close and seal door 28.

Figure 6:
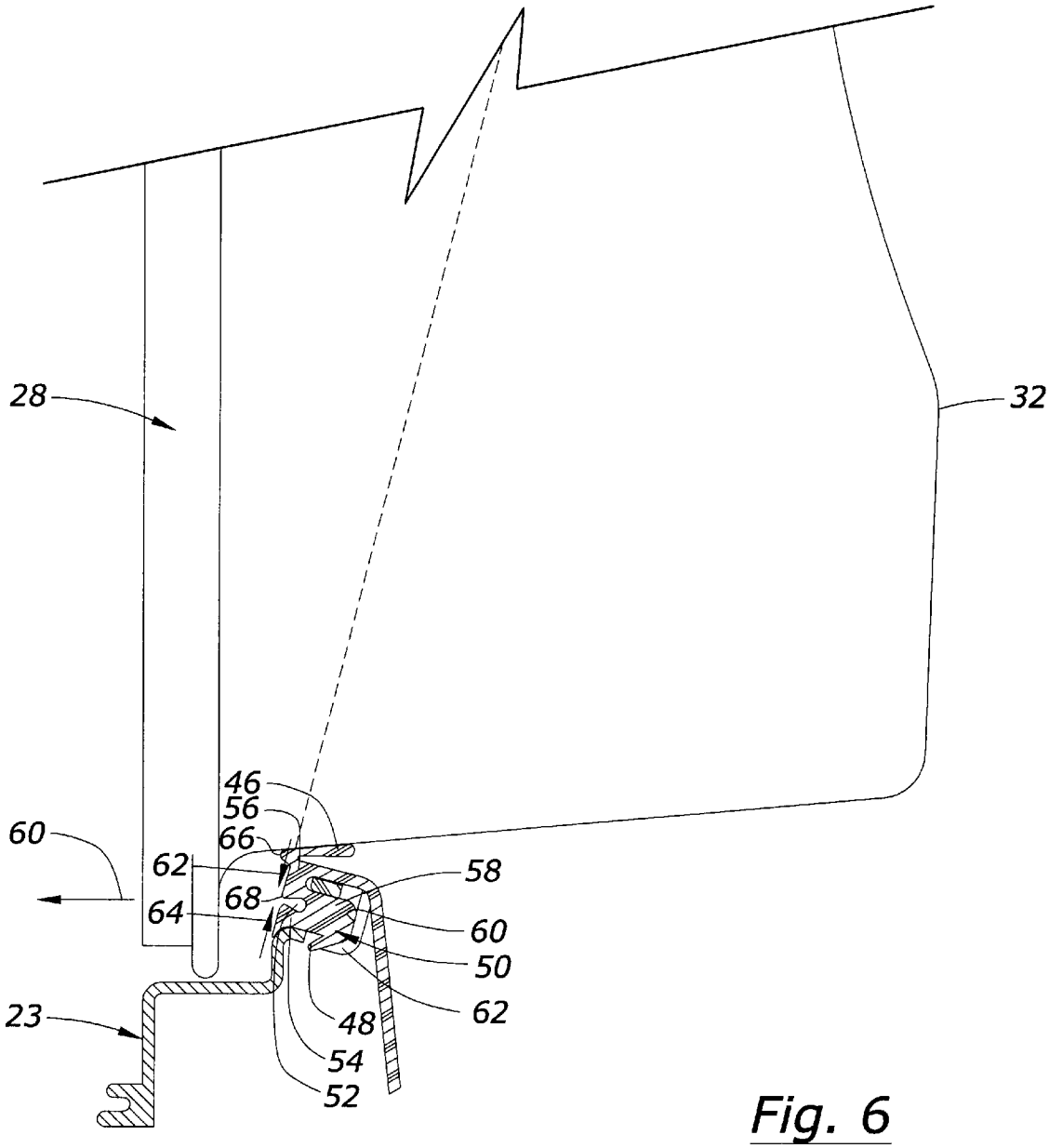
FIG. 6 is an enlarged sectional view similar to that of FIG. 3, but showing the deflection of the relief hinge during opening of the door.

Because of this fluid tight seal, there is a resistance force opposing the movement of the door 28 from its closed position toward its open position. FIG. 6 illustrates the movement of the door 28 towards its open position. As the initial movement begins, the sealing lip 46 begins to roll upon itself as indicated at 66, and this causes the hinge 50 to flex and pinch the edges of groove 52 together as indicated at 68 in FIG. 6. The legs 54, 56 move toward one another, and the groove 52 provides clearance for this movement. The effect of this flexing of hinge 50 reduces the force necessary to move the door from its closed to its open position. Arrows 62, 64 indicate the direction of movement of the legs 54, 56 toward one another. Arrow 60 illustrates the movement of the door 28 towards its open position. Once the seal is broken the door moves easily. Therefore the hinge 50 helps reduce the force 60 necessary to open the door 28 in opposition to the vacuum that is created by the seal between sealing lip 46 and the door plug 32.

The result of this construction is that the force required to close and seal the door is unaffected by the groove 52. However, the force required to open the door is reduced, and it has been found that the groove 52 reduces this force by approximately 25%.

Industry standards require that the total force required to open door 28 should be approximately 15 pounds. By reducing the force required to break the seal between the sealing lip 46 and the door plug 32, it is possible to increase the latching force with which latch 34 holds the door closed, while at the same time maintaining the total force required to open the door at approximately 15 pounds.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A sealing system for an appliance comprising:

a cabinet enclosing an appliance cavity;

an access opening in the appliance having an opening perimeter, the access opening providing access from the exterior of the cabinet to the appliance cavity;

a door boot extending around the perimeter of the access opening;

a door movably mounted to the cabinet for movement from an open position exposing the access opening for access to the appliance cavity to a closed position in covering position over the access opening;

the door having a door sealing surface and the door boot having a boot sealing surface which engage one another and provide a seal between the door and the cabinet when the door is in the closed position whereby the seal causes a resistance force opposing the movement of the door from the closed position to the open position; and a relief groove in the door boot permitting the door boot to flex in response to initial movement of the door from the closed position to the open position, whereby the flexing of the door boot reduces the magnitude of the opening force necessary to overcome the resistance force.

2. The sealing system of claim 1 wherein the door boot includes a relief hinge between the relief groove and the sealing surface of the door boot, the relief hinge flexing during the initial movement of the door from the closed to the open position.

3. The sealing system of claim 2 wherein the sealing surface of the door boot comprises a lip flange that engages the door and forms the seal when the door is in the closed position.

4. The sealing system of claim 2 wherein the relief hinge is a flexible hinge that bends during flexing.

5. The sealing system of claim 4 wherein the entire door boot is comprised of a flexible material.

6. An appliance having a cabinet, an appliance cavity within the cabinet, an access opening in the cabinet, and a door movable from an open position permitting access to the appliance cavity through the access opening to a closed position in covering relation over the access opening, an annular door boot surrounding the access opening and being positioned between the door and the cabinet when the door is in the closed position to provide a seal there between, the door boot comprising:

a sealing surface engaging the door and forming a seal between the door and the cabinet around the access opening when the door is in the closed position;

an annular groove surrounding the access opening;

a flexible hinge between the annular groove and the sealing surface; and the annular groove and the flexible hinge cooperating to cause flexing of the door boot at the flexible hinge during the initial movement of the door from the closed toward the open position.

7. The appliance of claim 6 wherein the sealing surface comprises a lip flange surrounding the access opening.

8. The appliance of claim 7 wherein the flexible hinge extends circumferentialy around the annular lip flange.

9. The appliance of claim 8 wherein the annular groove extends circumferentially around the flexible hinge and the annular lip flange.

10. A sealing system for an appliance comprising:

a cabinet enclosing an appliance cavity;

an access opening in the appliance having an opening perimeter, the access opening providing access from the exterior of the cabinet to the appliance cavity;

a door boot extending around the perimeter of the access opening;

a door movably mounted to the cabinet for movement from an open position exposing the access opening for access to the appliance cavity to a closed position in covering position over the access opening;

the door having a door sealing surface and the door boot having a boot sealing surface which engage one another and provide a seal between the door and the cabinet when the door is in the closed position whereby the seal causes a resistance force opposing the breaking of the seal during the initial movement of the door from the closed position to the open position; and the door boot having a flexible relief hinge extending around the perimeter of the access opening, the relief hinge flexing in response to the initial movement of the door from the closed position toward the open position so as to reduce the resistance force opposing the breaking of the seal.

11. A sealing system according to claim 10 wherein the flexible relief hinge comprises in cross section first and second spaced apart legs, each having first and second opposite ends, and a web joining the first ends of the first and second spaced apart legs, the first and second spaced apart legs and the web forming a relief groove between the first and second spaced apart legs.

* * * * *